United States Patent [19]

Winyard

[11] Patent Number: 4,941,811

[45] Date of Patent: Jul. 17, 1990

[54] LEAKAGE PATH INTERCONNECTION FOR SINGLE SCREW MECHANISMS

[75] Inventor: David C. Winyard, Annapolis, Md.

[73] Assignee: The United States of America as represented by the Secretary of the Navy, Washington, D.C.

[21] Appl. No.: 287,362

[22] Filed: Dec. 21, 1988

Related U.S. Application Data

[63] Continuation-in-part of Ser. No. 908,859, Aug. 25, 1986, Pat. No. 4,824,348.

[51] Int. Cl.[5] ..... F01C 1/20; F01C 3/08

[52] U.S. Cl. ..... 418/195; 418/196

[58] Field of Search ..... 418/195, 196

[56] References Cited

U.S. PATENT DOCUMENTS

| | | | |
|---|---|---|---|
| 711,083 | 10/1902 | Taylor | 418/195 |
| 1,437,464 | 12/1922 | Carroll | 418/144 |
| 1,654,048 | 12/1927 | Myers | 418/195 |
| 1,723,157 | 8/1929 | Guttinger | 418/195 |
| 2,994,276 | 8/1961 | Matson | 418/195 |
| 3,232,236 | 2/1966 | Karavias | 418/195 |
| 3,932,077 | 1/1976 | Zimmern | 418/195 |
| 4,321,022 | 3/1982 | Zimmern | 418/195 |
| 4,373,881 | 2/1983 | Matsushita | 418/195 |

*Primary Examiner*—John J. Vrablik

*Attorney, Agent, or Firm*—Luther A. Marsh; John H. Stowe; Thomas S. O'Dwyer

[57] ABSTRACT

The teeth of a gaterotor in a single screw mechanism has flanks in contact with the mainrotor thread which are relieved only on diagonally opposite sides above and below the gaterotor sealing plane at the leading inner and trailing outer tooth edges. When properly arranged in a mechanism capable of having multiple teeth engaged in a single screw thread, the blowhole leakage paths at the mainrotor thread crest-gaterotor tooth root-housing interface are interconnected between opposite chambers which are at equal pressure. This eliminates blowhole leakage and removes the primary limitation on gaterotor thickness and strength.

5 Claims, 3 Drawing Sheets

LEAKAGE PATH INTERCONNECTION FOR SINGLE SCREW MECHANISMS

The invention described herein may be manufactured and used by or for the Government of the United States of America for governmental purposes without the payment of any royalties thereon or therefor.

CROSS RELATED REFERENCES TO RELATED APPLICATIONS

This application is a continuation in part of application Ser. No. 06/908,859, filed Aug. 25, 1986, now U.S. Pat. No. 4,824,348.

BACKGROUND OF THE INVENTION

1. Field of the Invention the present invention relates to an improvement in single screw mechanisms of the multiple tooth engagement type for varying the pressure of a fluid such as a liquid pump, gas compressor or expander, rotary engine or the like.

2. Description of the Prior Art

The group of single screw machine which is of concern to the present invention are classified as positive-displacement rotary type machines. Mechanisms of this type generally consist of a mainrotor which meshes with two or more symmetrically opposed gaterotors. The gaterotor teeth sweep through the mainrotor threads drawing fluid into the chamber from an inlet port provided in the machine's housing and forcing fluid from the thread into an outlet port in the housing. Sufficient torque is supplied by prime mover means for rotation of the mainrotor towards the gaterotor tooth to overcome the outlet pressure being generated in the closed pocket of fluid defined in the chamber between the machine housing, mainrotor threads and gaterotor tooth.

In conventional single screw mechanisms, the gaterotor teeth are required to separte the pressure in the closed compression chamber from the inlet pressure of the suction plenum so this is an area that has a large effect on machine performance. Due to the relative angle of motion between the gaterotor and the mainrotor, as the gaterotor's teeth travel through the mainrotor thread, the tooth flanks must be beveled above and below the sealing plane to prevent binding. The angles by which the gaterotor teeth flanks are relieved is determined by the minimum and maximun angles at which the gaterotor tooth edge and the mainrotor thread walls intersect and a radial line from the gaterotor axis to the point of contact. The necessity of providing these reliefs however, presents a problem in that they initiate flow paths out of the chamber enclosed by the tooth along the length of the tooth. As can be seen in FIG. 1, conventional gaterotor tooth design is represented by the convergence of two skewed planes machined at the minimum and maximum relative angles fo motion coming into contact with the mainrotor thread 18 so as to create a single sealing edge along the tooth flank during rotational motion. It should be recongnized that each gaterotor tooth flank must be relieved by these angles and that these flank angles remain substantially parallel about the sealing plane 17 throughout the pressure changing cycle.

Leakage paths out of the pocket in the chamber enclosed in the mainrotor thread between the tooth of one gaterotor and the machine housing can be classified into at least two major kinds. The first of these leakage paths is a route directly past the gaterotor teeth flanks in a direction that is perpendicular to the tooth face. The second major leakage path of concern, is in a direction that is parallel to the tooth face over the crest of the mainrotor thread crest where the root of adjacent gaterotor teeth engage. This latter leakage path will hereinafter be referred to as a blowhole leakage path and occurs at the mainrotor thread crest-gaterotor tooth root-housing interface. Both leakage paths exist in all single screw machinery and it has been demonstrated that the mass of fluid that will flow past the gaterotor tooth from the closed chamber pocket to the suction plenum is proportional to the square root of their absolute pressure difference.

In attempting to limit the amount of leakage past gaterotor teeth, past practice has been to limit the size of the downholes by reducing gaterotor tooth thickness, by reducing pocket sealing plane depth below the pocket side of the gaterotor tooth, and by reducing the difference between the maximum and minimum relief angles requrired at the gaterotor tooth flanks. Several notable attempts have been made in this regard as exemplified, by way of example, in U.S. Pat. No. 3,932,077, wherein volumetric discharge is increased by a gaterotor tooth seal which has arch shaped flanks so that surface to surface contact with the mainrotor thread is made within a zone. The major drawbacks of this design are that mainrotor thread machining takes a long time and that whenever parallel cylinder profiles are used, leakage past the flank areas become major. Recognizing these difficulties, U.S. Pat. No. 4,321,022 proposes gaterotor teeth flanks comprising at least three skewed surfaces which intersect in at least two edges so as to provide dual lines of sealing with the mainrotor thread as can be seen in FIG. 2.

Although many previous single screw pump devices including U.S. Pat. Nos. 1,437,464, 1,654,048, 1,723,157, 2,994,276, and 3,232,236 have utilized a mainrotor which contains thread windings in excess of 180° the inventor's co-pending application Ser. No. 06/908,859, now U.S. Pat. 4,824,348 filed Aug. 25, 1986, which is hereby incorporated by reference, discloses a novel multiple tooth engagement single screw mechanism. This machine improves upon the conventional single screw design by increasing the gear ratio and by allowing the wrap angle to exceed the conventional 360° divided by the number of gaterotors so that several teeth are simultaneously engaged in each mainrotor thread. The advantage of this design is that it breaks down the high to low pressure gradient across two or more gaterotor teeth engaged in a single mainrotor thread. Leakage past the gaterotor tooth flanks in such a mechanism is reduced since the differential pressure across the gaterotor tooth is attenuated.

The previoiusly discussed single screw mechanisms are representative of conventional designs and improvements thereto as disclosed by the inventor and others when dealing with the problem of volumetric efficiency. Although several embodiments have been discussed, the designs of the prior art contain various limitations and offsetting disadvantages so that the effort to reduce leakage remains a major design consideration in single screw machinery. The embodiments hereinafter illustrated and described are distinguishable in the many ways they create better performing seals by reducing or eliminating gaterotor tooth leakage, allowing higher pressure capability, and removing the primary limitation on gaterotor tooth thickness.

SUMMARY OF THE INVENITON

A single screw mechanism consisting of a compound mainrotor having an outer surface profile and an inner base surface formed by a plurality of threads with a corresponding plurality of cylindrical gatertors rotating around axes skew to each other and symmetrically skew to the mainrotor axis, rotating such that as the gaterotor teeth flanks enter the mainrotor they encounter the minimum relative angle of motion between the teeth and the mainrotor and as the teeth flanks leave the mainrotor they encounter the maximum relative angle of motion between the teeth and the mainrotor.

When this condition is produced in a device as described above which is capable of having multiple gaterator teeth engaged in a single mainrotor thread, the relative angle of motion relationship requires that one provide maximum relative relief angles which exist only at the leading inner and trailing outer gaterotor tooth flanks thereby interconnecting opposite chambers at equal pressure and negating losses formerly encountered through the blowhole leakage paths.

Accordingly, one object of the present invention is to eliminate blowhole leakage which is experienced at the mainrotor thread crestgaterotor tooth root-housing interface.

Another object of the invention is to provide a single screw mechanism wherein the losses encountered past the gaterotor teeth flanks are reduced thereby increasing volumetric efficiency.

A further object of the invention is to provide a single screw device capable of high pressure operation by removing the primary limitation on gaterotor tooth thickness and strength.

BRIEF DESCRIPTION OF THE DRAWINGS

In the drawings, like reference characters designate identical corresponding parts throughout the several views.

DETAILED DESCRIPTION OF THE INVENTION

Figure 4:
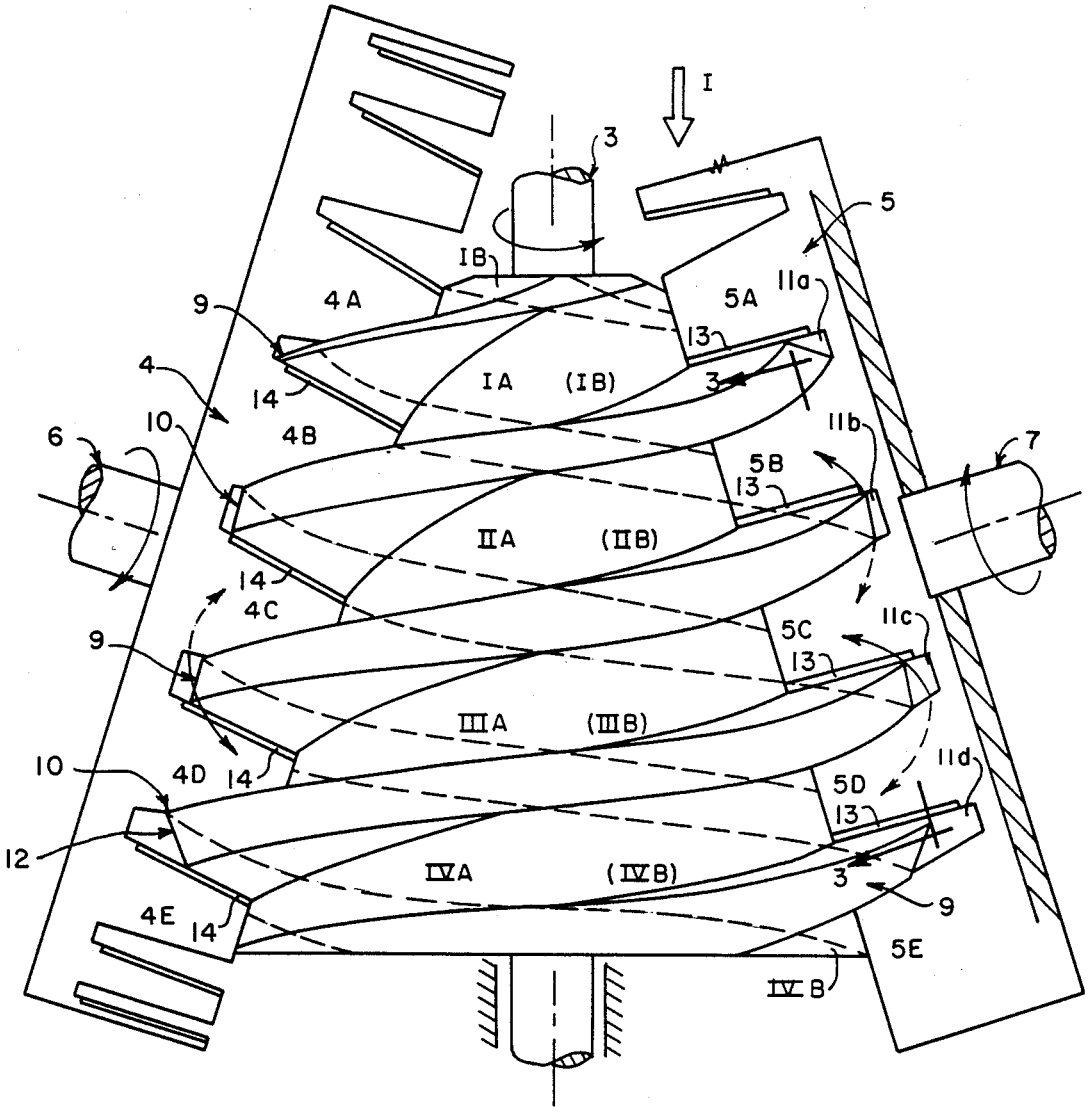
FIG. 4 is a longitudinal cross section of a multiple tooth engagement single screw device illustrating interconnected mainrotor chambers.
Figure 5:
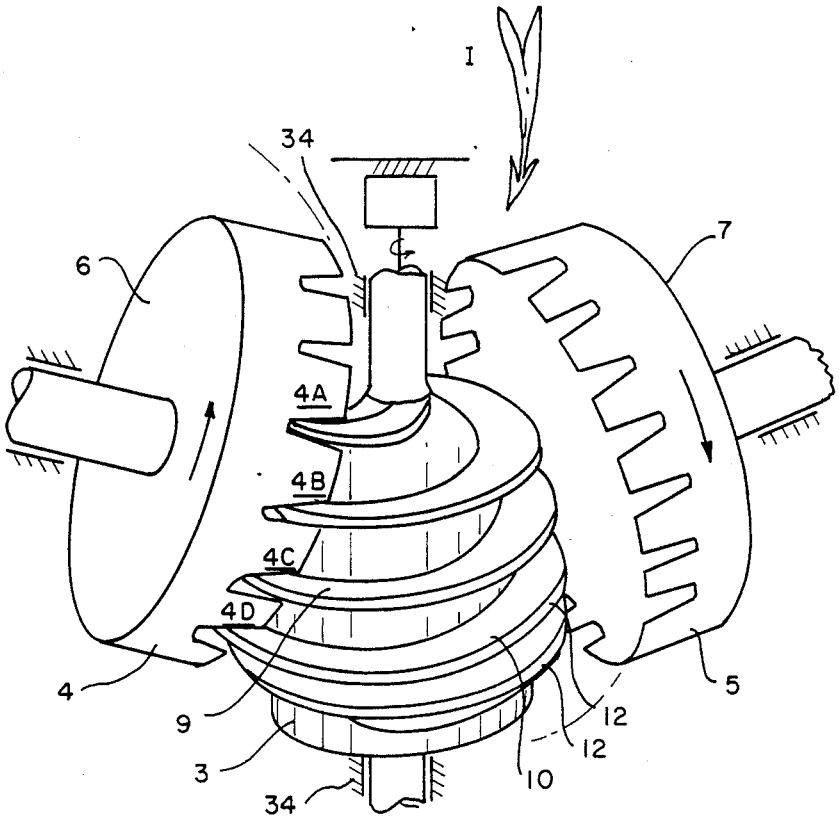
FIG. 5 is an exploded view in perspective of a single screw machine of the present invention.
Figure 5:
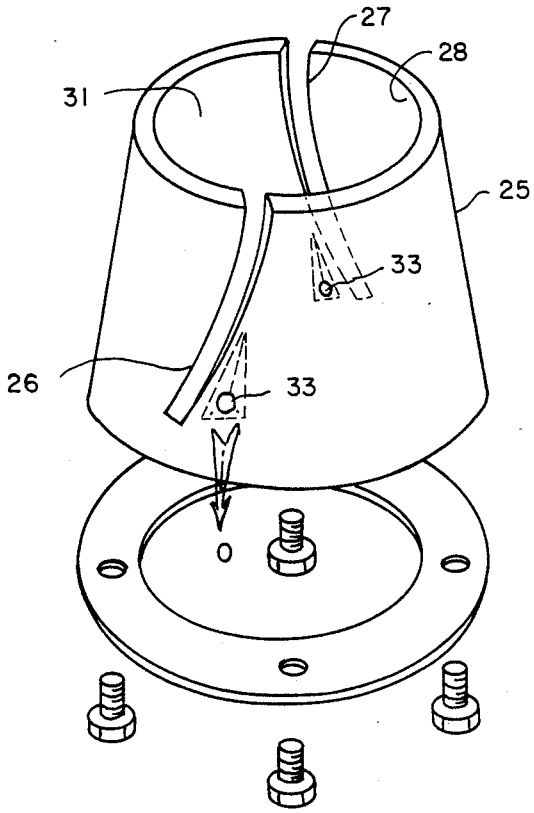

A preferred single screw mechanism geometry suitable for incorporation of the present gaterotor tooth flank design consists of a multiple tooth engagement type device wherein a compound mainrotor has an outer surface profile and an inner base surface formed by a plurality of threads with a corresponding plurality of cylindrical gaterotors each rotating around axes skew to each other and symmetrically skew to the mainrotor. By way of example, FIGS. 4 and 5 illustrates such a single screw mechanism comprising a truncated conical mainrotor 3, having two mainrotor threads 9 and 10, with a generally helicoid shape each of which wind around the mainrotor at least one full turn and preferably two or more full turns. The mainrotor thread crests 12 are intended to cooperate with the interior 28 of a housing 25 as shown in FIG. 5, having a bore symmetry which surrounds, at least to a partial extent, the conical mainrotor 3. The two cylindrical gaterotors 6 and 7, with toothed outer peripheral surfaces 4 and 5, have teeth 4A through 4E and 5A and 5D for meshing with the mainrotor threads. When engaged, these teeth form pockets of fluid in the mainrotor chamber grooves between the casing and two gaterotor teeth. For example, tooth 5B and tooth 4C of FIG. 4 seals off a pocket IIA of fluid between mainrotor threads 9 and 10. Therein tooth 5B provides a seal between pocket IIA and fluid in prior pockets closer to the inlet, indicated by the arrow labeled I, while tooth 4C provides a seal between pocket IIA and fluid in succeeding pockets nearer the discharge. Referring now to FIG. 5, mainrotor 3 is adapted to rotate in housing 25 with crests 12 of threads 9 and 10 cooperating with the inner periphery 28 of housing 25 forming chambers. Toothed outer peripheral surfaces 4 and 5 on gaterotors 6 and 7 respectively extend through housing 25 via slots 26 and 27 respectively and engage mainrotor threads 9 and 10. Slots 26 and 27 are milled for a close clearance to the thickness of toothed outer pripheral surfaces 4 and 5. In the embodiment shown in FIG. 5, and end 31 of housing 25 serves as a fluid inlet for inlet fluid I and fluid outlet bores 33 and **33*a* serve as outlets for outlet fluid O. Mainrotor 3 is supported by bearings indicated generally as 34**.

The advantage of single screw machines of this design is that they utilize more than one tooth to sweep out a mainrotor thread. The pressure differences from outlet to inlet are thus sealed by several gaterotor teeth. Depending upon the number of mainrotor windings, the high to low pressure gradient is thus broken down across two or more gaterotor teeth engaged in the single mainrotor thread. As is shown in FIG. 4, these multiple tooth engagement devices create closed pockets at IA through IVA in front of the gaterotor tooth and (IB) through (IVB), indicated by the dashed mainrotor thread lines, behind the gaterotor tooth that is filled with fluid when the mainrotor rotates and closes off the fluid inlet port. Closing of the trailing chamber results in opposed pressure chambers which are at identical pressure histories if there are two symmetrically opposed generators.

In machines of this design, the volume of the interteeth pockets can be controlled by varying the mainrotor diameter axially. For a liquid machine such as a pump, the diameter must vary such that the volumes swept by the enclosing teeth are equal in order not to compress an incompressible fluid. To prevent the volume of the enclosed pocket IIB, for example, from changing, each tooth must have an equal instantaneous rate of volume swept, as is represented by the general formula: $A_{4B}R_{4B}d\theta = A_{5C}R_{5C}d\theta = \text{Constant}$, where A is the area of the engaged portion of either tooth, R is the average radius of the projected tooth area, and $d\theta$ is an increment of mainrotor rotation. This means that for the conical mainrotor profile shown in FIG. 4, as the average radius increases along the length of the mainrotor, the area tooth 5C engages will have to decrease in an amount which compensates for its radial increase in order for the leading 5C and trailing 4B pocket teeth to sweep equal volumes per unit of rotation.

For a gas machine such as a compressor, or in a similar reverse manner an expander, the diameter of the mainrotor must vary such that the volume swept by the enclosing teeth decrease in order to compress. To insure that the volume of the enclosed pocket is decreasing, the trailing 4B pocket tooth must have a greater instantaneous rate of volume swept than the leading 5C tooth, as is represented by the formula: $A_{4B}R_{4B}d\theta > A_{5C}R_{5C}d\theta$. This means that for the conical mainrotor shown in FIG. 4, as the average radius increases along the length of the mainrotor, the amount of area tooth 5C engages will again have to decrease, but at a faster rate than in the pump situation above if the trailing 4B pocket tooth is to sweep a greater volume per unit of rotation than the leading 5C tooth. This is typical of conventional compressor/expander devices where the gaterotor tooth fully disengages with the mainrotor at discharge.

Thus, it is to be understood that mainrotor-gatertor configurations other than the compound conical profile illustrated in FIG. 4 are acceptable, including a cylindrical mainrotor design wherein the conical base surface contains two threads multiply wound with two cylindrical gaterotors rotating around axes skew to each other and symmetrically skew to the mainrotor. Reversing both the mainrotor and gaterortor axes of rotation is also acceptable. In accordance with the teachings of this inventioń, these and other geometries are acceptable provided penetration into the mainrotor by the gaterotor teeth is constantly decreasing as is shown in FIG. 4.

Figure 1:
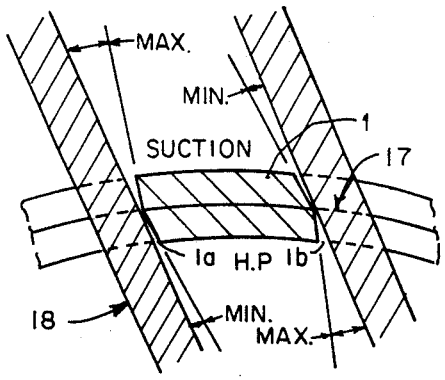
PRIOR ART FIG. 1
FIGS. 1 through 2 are transverse cross sections of gateotor teeth flanks of the prior art.
Figure 2:
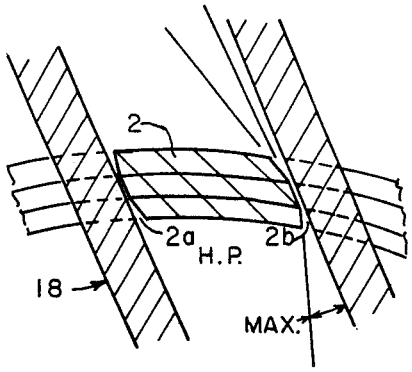
PRIOR ART FIG. 2

Recalling now from the previous pior art discussion as represented in FIGS. 1 and 2, the relative angle change of the gaterotor tooth flank as it rotates through the mainrotor has a significant effect on the volumetric efficiency of single screw machines. The angles by which the gaterotor flanks must be relieved, in order to permit substantially fluid-tight engagement with the mainrotor thread walls without binding, permits leahage in that they open up paths for flow out of the pocket enclosed by the tooth along the tooth flank's length in directions that are both parallel and perpendicular to the gaterotor spin axis. In present art single screw machines, a gap is created at the root between adjacent gaterotor teeth and the mainrotor thread crests during rotational engagement as can be seen at 11*a* through 11*d* in FIG. 4.

In conventional single screw pumps which operator on an incompressible fluid, the area of these gaps will slowly increase as one progresses from inlet to discharge in order to maintain a constant volume in the pockets. In conventional single screw compressors which operate on a compressible gas, the area of these gaps will increase more rapidly so that the volume in the pockets decreases as the gaterotor progresses through the mainrotor. Such blowhole leakage paths exist in all single screw machinery at the mainrotor thread crest-gaterotor teeth root-housing interface. Therefore, in addition to leakage paths past the gaterotor tooth flanks normal to the tooth face, fluid emanating at the flank relief angles 1*a* and 1*b* in FIG. 1 and 2*a* and 2*b* in FIG. 2, flow up the tooth flanks and over the mainrotor thread meant to seal the leading closed chamber from the trailing suction chamber through these blowholes.

Typical blowhole sizes in the past have equaled approximately 0.001 squares inches. The volumeric flow rate through such a blowhole can be calculated from the following formula:

$$Q = A\sqrt{2P/\rho}$$

where A = area (0.001 in$^2$), P = differential pressure, and $\rho$ = fluid density. For a differential pressure of 1000 psi and a specific gravity of 1, flow is 1.3 gallons per minute for each blowhole. This amount of leakage is significant, especially for a small displacement machine. By selection of particular mainrotor-gaterotor configurations, this invention will eliminate losses through some or all of these blowhole leakage paths by interconnecting adjacent opposite chambers.

Figure 3:
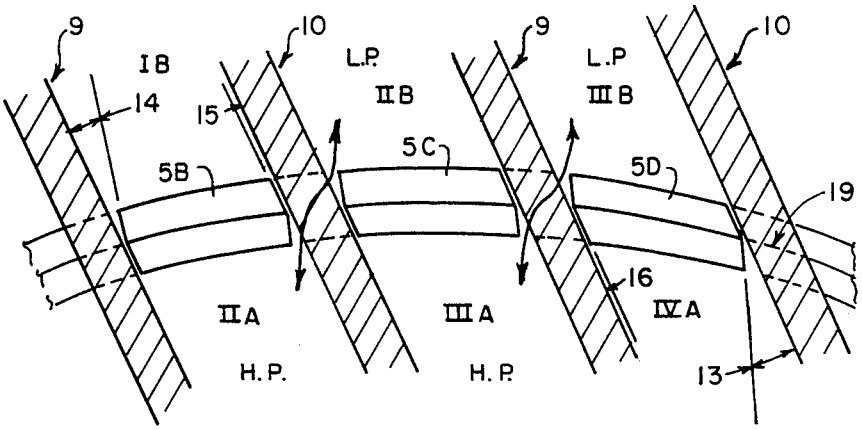
FIG. 3 is a transverse cross section from FIG. 4 of gaterotor teeth flanks in accordance with the present invention.

In machines of the multiple tooth engagement type as hereinbefore described, if one selects an appropriate gear ratio and angle of inclination between the mainrotor and gaterotor axes so as to meeet the condition that when the gaterotor tooth flanks enter the mainrotor they encounter the minimum relative angles of motion between the tooth and the mainrotor and as the tooth flanks leave the mainrotor they encounter the maximum relative angle of motion between the tooth and the mainrotor, the relative angle of motion relationship will require gaterotor teeth relief angles cut in such a way as to produce the desired blwohole location. In so meeting the above stated condition, one has defined gaterotor tooth flank wherein maximum relief angles are required only at the leading inner 13 and the trailing outer 14 tooth edges below and above the gaterotor sealing plane 19 respectively as is shown in FIG. 3. In this design, the minimum relief angles required at the leading outer 15 and trailing inner 16 tooth edges substantially conform to the mainrotor thread walls thereby greatly attenuating the leakage past the gaterotor tooth flanks in the direction normal to the tooth face.

The present invention thus location a set of single screw mechanism geometries having a unique arrangement of gaterotor tooth blowholes. It includes all such machines having at the point of penetration into the mainrotor surface of rotation around its axis, relief angles, which on either the high or low pressure side of the tooth are only present on the leading or trailing tooth flank of a gaterotor tooth nearest the discharge or inlet port on that respective side of the tooth as is represented in the FIG. 3 cross section from FIG. 4. Thus, the teeth of a gaterotor in accordance with the present invention, has flanks in contact with the mainrotor thread which are relieved only on diagonally opposite sides above and below the gaterotor sealing plane at the leading inner and trailing outer tooth edges.

When the requisite geometry is produced in a multiple tooth insertion mechanism, losses experienced at the mainrotor thread crest-gaterotor root crest gap, in the direction parallel to the gaterotor spin axis, are reduced by interconnecting all of these blowholes. That is, the relief angle on the leading edge of the gaterotor tooth flank are interconnected with the trailing edge of the tooth flank in the adjacent pressure chamber. The dual opposed pressure chamber of these devices are at identical pressure histories. That is, for instance, no pressure differential exists across the blowholes of mainrotor chamber IIA defined between gaterotor teeth 4C–5B on the front side and chamber IIB defined betwen gaterotor teeth 4B–5C on the backside. Thus, by directing leakage flow through paths that communicate only with adjacent opposite chambers at equal pressure,losses through the blowhole route is effectively neutralized since the connected chambers interface at gaps 11*a* through 11*d* are at dynamic equilibrum. The arrows in the FIG. 3 cross section from FIG. 4 illustrate an example of this arrangement. As shown, the blowholes are so arranged that they serve only to connect the two threads at symmetric points are at equal pressure thereby virtually eliminating leakage past the blowholes. In machines where the mainrotor has more that two threads, all blowholes will be interconnected if an equal number of gaterotors are used.

The outstanding feature of this invention is that when a multiple tooth engagement machine is so arranged to maintain blowholes as hereinbefore described, all of these blowholes will serve only to connect chambers of fluid at equal pressure, thereby eliminating pressure losses formerly encountered through such blowholes. A reduction in losses past the gaterotor tooth flank is also realized by retention of a minimum relative flank relief angle which substantially conforms to the mainrotor thread walls. An additional advantages for mechanism designed in accordance with the teachings of this invention, is that of gaterotor tooth thickness independence.

For a multiple tooth insertion mechanism, tooth must resist differential pressure across the tooth face without a large metallic stiffener. The non-metallic gaterotor tooth must be thick enough to resist these loads without a stiffener. For a high pressure machine, the tooth thickness necessary to resist the high loads imposed would be great, creating a large blowhole and high leakage. Use of this invention in its simplest form, with two mainrotor threads allow high pressures and the requisite thick gaterotor teeth without blowhole losses.

Therefore, while this disclosure has focused on the fields of pump and compressor technology, and in a similar reverse manner to gas expanders, it should be understood that this invention applies to any single screw machine of the multiple tooth engagement type with the necessary blowhole configuration which are required to operate on either compressible or incompressible fluids. Obviously numerous modifications and variations of the present invention are possible in light of the above teachings. It is therefore to be understood, that within the scope of the appended claims, the invention may be practiced otherwise than as specifically described herein.

What is claimed is:

1. A single screw mechanism having an inlet and an outlet, comprising:

a compound mainrotor formed with a plurality of threads, each said thread having a thread winding around said mainrotor of at least one full turn, said mainrotor having a varying radius along the length of said mainrotor;

a housing, cooperating with said mainrotor threads, forming at least one chamber, each said chamber in fluid communication at a first end with said inlet of said single screw mechanism and in fliud comunication at a second end with said outlet of said single screw mechanism;

a plurality of cylindrical gaterotor having teeth which are in meshing relation with said mainrotor threads, said gaterotor teeth sealedly cooperating with each said chamber such that said first end of each said chamber is sealed from said second end of each said chamber by a plurality of teeth of one gaterotor and at least one tooth of another gaterotor for at least a portion of each cycle, forming pockets, each said pocket bounded by a leading tooth of one gaterotor and a trailing tooth of another gaterotor;

characterized in that the instantaneous rate of volume swept by each said tooth per unit of mainrotor rotation and the volume of each said pocket are controlled by varying the engaged area of each said gaterotor tooth commensurate with said varying radius of said mainrotor as each said tooth progresses along the length of said mainrotor.

2. A single screw mechanism having an inlet and an outlet, comprising:

a mainrotor formed with a plurality of threads, each said thread having a thread winding around said mainrotor of at least one full turn;

a housing, cooperating with said mainrotor threads, forming at least one chamber, each said chamber in fluid communication at a first end43 5ith said inlet of said single screw mechanism and in fluid communication at a second end with said outlet of said single screw mechanism;

a plurality of cylindrical gaterotors corresponding to the number of mainrotor threads each rotating around axes skew to each other and symmetrically skew to the mainrotor axis and each having teeth which are in meshing relation with said mainrotor threads, said gaterotor teeth sealedly cooperating with each said chamber along a gaterotor sealing plane such that said first end of said chamber is sealed from each said second end of said chamber by a plurality of teeth of one gaterotor and at least one tooth of another gaterotor for at least a portion of each cycle;

characterized in that as the gaterotor teeth flanks enter the mainrotor they emcounter the minimum relative angle of motion between the teeth and said mainrotor and as the teeth flanks leave the mainrotor they encounter the maximum relative angle of motion between the teeth and said mainrotor.

3. A single screw mechanism in accordance with claim 2, wherein relief angles are provided above and below said gaterotor sealing plane only at the leading inner and trailing outer edges of said gaterotor teeth flanks therby interconnecting opposite chambers at equal pressure.

4. A single screw mechanism having an inlet and an outlet, comprising:

a compound mainrotor formed with a plurality of threads, each said thread having a thread winding around said mainrotor of at least one full turn, said mainrotor having a varying radius along the length of said mainrotor;

a housing, cooperating with said mainrotor threads, forming at least one chamber, each said chamber in fluid communication at a first end with said inlet of said single screw mechanism and in fluid communication at a second end with said outlet of said single screw mechanism;

a plurality of cylindrical gaterotors corresponding to the number of mainrotor threads each rotating axes skew to each other and symmetrically skew to the mainrotor axis and each having teeth which are in meshing relation with said mainrotor threads, said gaterotor teeth sealedly cooperating with each said chamber along a gaterotor sealing plane such that each said first end of said chamber is sealed from each said second end of said chmaber by a plurality of teeth of one gaterotor and at least one tooth of another gaterotor for at least a portion of each cycle, forming pockets, each said pocket bounded by a leading tooth of one gateroto and a trailing tooth of another gaterotor;

characterized in that the instantaneous rate of volume swept by each said tooth per unit of mainrotor rotation and the volume of each said pocket are controlled by varying the engaged area of each said gaterotor tooth commensurate with said varying radius of said mainrotor as each said tooth progresses along the length of said mainrotor.

and further characterized in that as the gaterotor teeth flanks enter the mainrotor they encounter the minimum relative angle of motion between the teeth and said mainrotor and as the teeth flanks leave the mainrotor they encounter the maximum angle of motion between the teeth and said mainrotor.

5. A single screw mechanism in accordance with claim 4 wherein relief angles are provided above and below said gaterotor sealing plane only at the leading inner and trailing outer edges of said gaterotor teeth flanks thereby interconnecting opposite chambers at equal pressure.

* * * * *